United States Patent [19]

Asanuma

[11] Patent Number: 4,550,826

[45] Date of Patent: Nov. 5, 1985

[54] SEMI-RIGID CONTAINER WITH A BOTTOM OF IMPROVED STABILITY

[75] Inventor: Mari Asanuma, Monroe, N.Y.

[73] Assignee: International Paper Company, New York, N.Y.

[21] Appl. No.: 581,356

[22] Filed: Feb. 17, 1984

[51] Int. Cl.[4] ..... A24F 15/00; B65D 85/10

[52] U.S. Cl. ..... 206/259; 206/273; 229/87 R; 229/5.5

[58] Field of Search ..... 229/87 R, 5.5; 206/259, 206/273

[56] References Cited

U.S. PATENT DOCUMENTS

| | | | |
|---|---|---|---|
| 2,128,904 | 9/1938 | Belcher | 229/87 R |
| 2,232,088 | 2/1941 | Waters | 229/61 |
| 2,339,305 | 1/1944 | Wagner | 99/178 |
| 2,353,746 | 7/1944 | Moore | 99/171 |
| 2,374,793 | 5/1945 | Waters | 93/3 |
| 2,382,573 | 8/1945 | Moore | 93/36 |
| 3,067,923 | 12/1962 | Thiets | 229/14 |
| 3,079,065 | 2/1963 | Kessler | 229/57 |
| 3,126,796 | 3/1964 | Vergobbi | 93/35 |
| 3,390,829 | 7/1968 | Malby | 229/61 |
| 3,430,845 | 3/1969 | Susuici et al. | 229/87 R |
| 3,998,378 | 12/1976 | Vetten | 229/3.1 |
| 4,267,957 | 5/1981 | Holmstrom | 229/37 R |
| 4,287,247 | 9/1981 | Reil | 428/129 |

FOREIGN PATENT DOCUMENTS

| | | | |
|---|---|---|---|
| 1280136 | 10/1968 | Fed. Rep. of Germany | 229/87 R |
| 7015 | of 1907 | United Kingdom | 229/87 R |
| 559832 | 3/1944 | United Kingdom | 229/87 R |

*Primary Examiner*—Joseph Man-Fu Moy
*Attorney, Agent, or Firm*—Richard J. Ancel

[57] ABSTRACT

A container is disclosed, having a substantially V-shaped creasing pattern on the bottom end wall portion to promote an inward bending of the bottom end wall to improve the stability of the container. The container has a V-shaped crease line on the bottom end wall of the container, the apex of the "V" pointing generally away from the center of the bottom end wall.

24 Claims, 10 Drawing Figures

FIG. 4
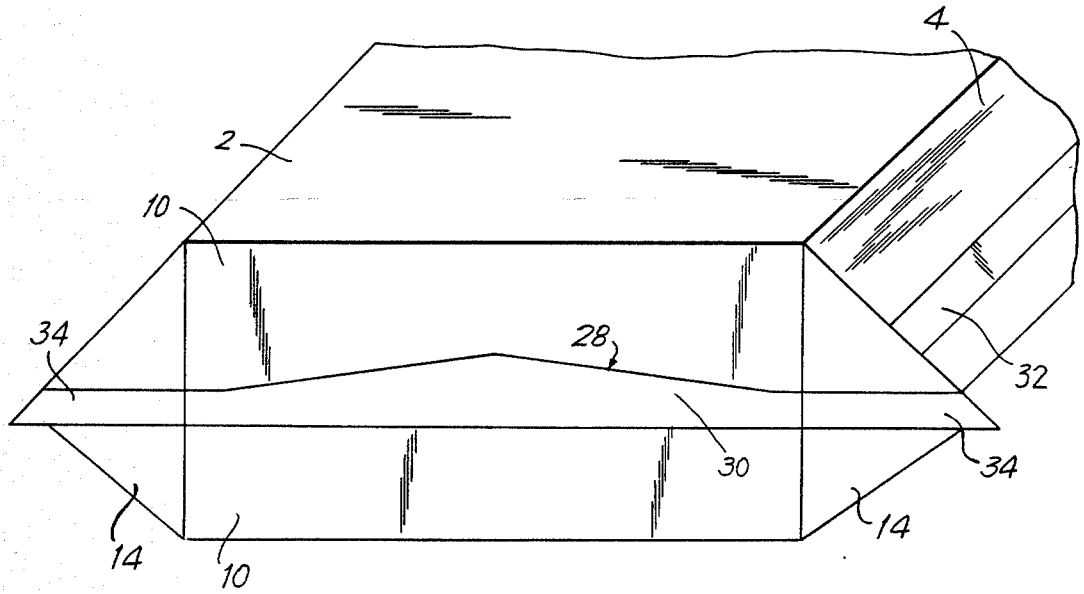
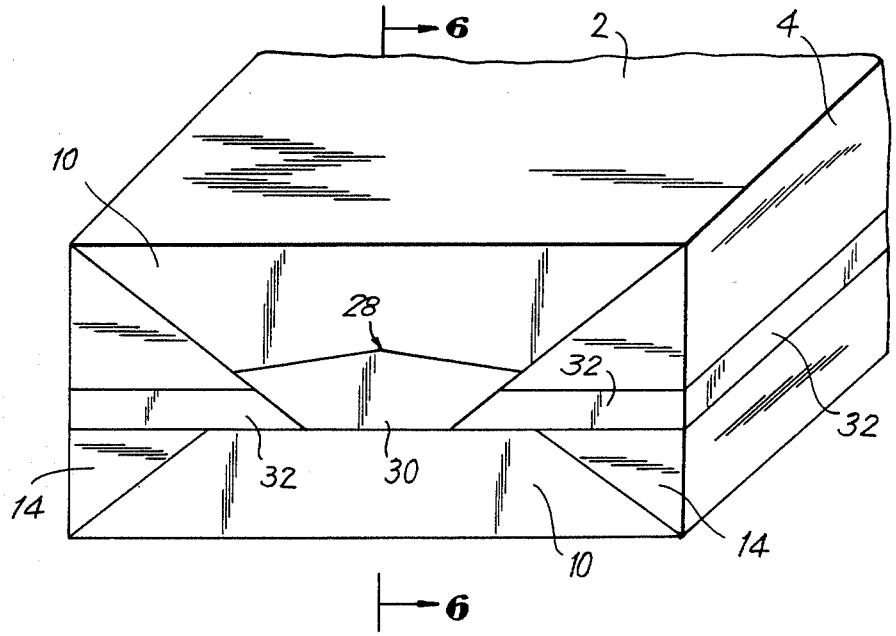
FIG. 5

FIG. 9
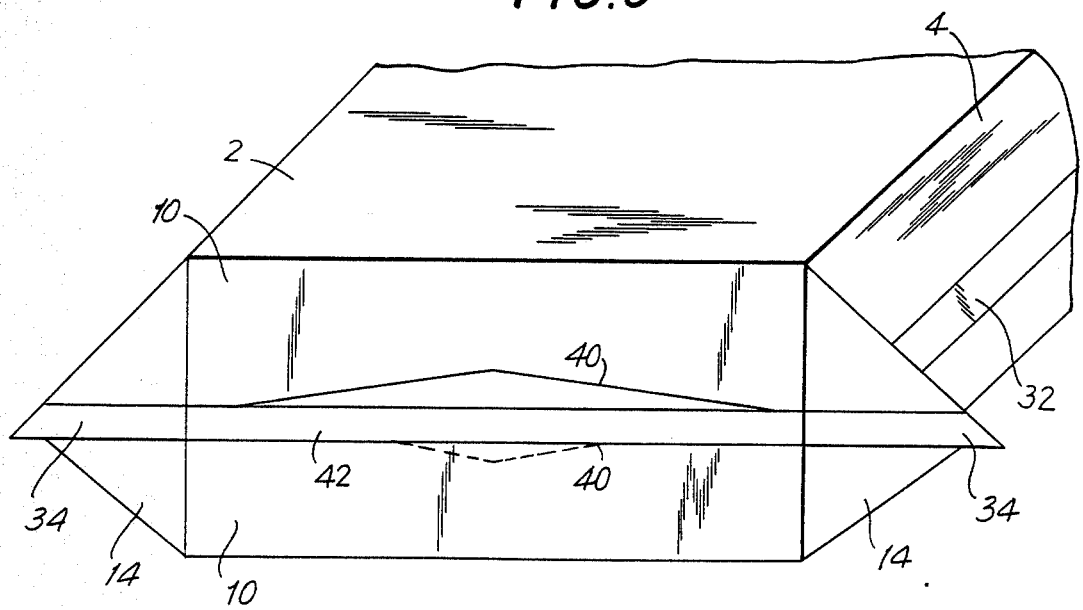
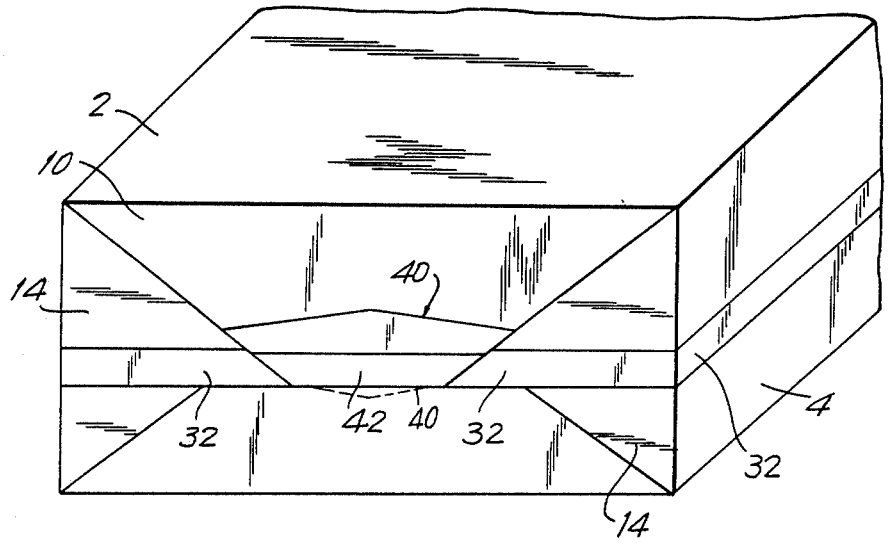
FIG. 10

SEMI-RIGID CONTAINER WITH A BOTTOM OF IMPROVED STABILITY

BACKGROUND OF THE INVENTION

The present invention relates generally to containers made of paperboard or other semi-rigid materials, especially liquid-tight aseptic containers, and relates more particularly to containers of that type having a brick-shaped configuration.

The constructions of various parallelepipedic and other non-round containers are known in the art. Examples are disclosed in U.S. Pat. Nos. 2,232,088 and 2,374,793, issued to H. F. Waters, as well as U.S. Pat. No. 3,067,923, issued to C. W. Thiets, and U.S. Pat. No. 3,390,829, issued to H. S. Malby. Typically, such containers are formed from blanks or laminate sheets provided with a pattern of score lines or fold lines along which the blank is folded to form a container which includes a bottom end wall and a triangular flap, or dog ear, projecting most commonly from each of the shorter sides of the bottom end wall. The dog ears consist of excess material not needed to define the six faces or walls of the body of the container and are typically folded in against the bottom end wall.

The folding in of the dog ears presents problems as to flatness and stability of the container bottom, particularly in those cases where both the bottom end wall and each dog ear contain sealing fins (tabs or flaps formed during construction of the container by sealing the edge portions of two layers of material together face to face). In such instances, a relatively large number of layers of laminate material (e.g., as many as eight) are located on top of each other where the dog ears are folded against the bottom end wall, resulting in an excess of folded material at the bottom of the container. Because of this excess material, the bottom of the container is no longer flat, and the ability of the container to stand upright in a stable manner is reduced.

Two recent patents disclose attempts to solve this problem. U.S. Pat. No. 3,998,378, issued to W. Vetten, describes a box with a rectangular bottom that is said to arch inward at its center due to the procedure disclosed in that patent for constructing the container from a blank. The part of the blank that will become the bottom portion of the container consists of two sets of panels. The panels of one set, which will form dog ears upon folding, are located most commonly at shorter sides of the box and those of the other set are rectangular areas which will form the end wall panels of the container bottom. During container construction, the dog ears are first folded inward and are then overlapped by the rectangular end wall panels to form the bottm of the container. The bottom is then sealed via a fillet seam along the periphery of the bottom end wall.

U.S. Pat. No. 4,267,957, issued to Holmstrom, discloses a differently shaped package bottom. No crease lines are provided for the dog ears to be folded at. Instead, crease lines are provided on the bottom end wall panel, each with one end at a corner where the dog ear joins the bottom end wall, the other end of each slanting slightly toward the center of the bottom end wall. This scoring pattern results in an inward bending of the sides of the bottom end wall along the crease line when the dog ears are folded in against the bottom end wall, thus eliminating bulging of the container in those areas.

In contrast, the present invention utilizes novel sealing or creasing patterns on a sheet of semi-rigid container material which, upon construction of the container, result in an inward bending of the central portion of the bottom end wall. A space is thereby created into which the dog ears can be neatly placed, resulting in a flatter, more stable container bottom.

It is therefore the principal object of the present invention to provide a liquid-tight aseptic container made of paperboard or a similar semi-rigid material, and having a bottom of improved flatness and stability.

Another object of the invention is to provide a blank of semi-rigid material scored appropriately for folding to form such a container with an improved bottom.

Still another object of the invention is to provide a laminate web of semi-rigid material having a plurality of prescored regions to be utilized in the production of containers with bottoms of improved flatness and stability.

SUMMARY OF THE INVENTION

The container of the invention is made of a semi-rigid material, such as paperboard, and includes side walls and a bottom end wall with a sealing fin running horizontally along the center of the bottom end wall. Dog ears formed at two opposing sides of the bottom end wall during the construction of the container body are folded in against the sealed bottom. The container is provided with a substantially V-shaped crease line on the bottom end wall.

According to one preferred embodiment of the invention, the bottom end wall is sealed along the substantially V-shaped crease, to form a roughly triangular bottom sealing fin, the portion of the fin near the center of the bottom end wall being wider than the ends of the fin. The crease thus serves as the bottom sealing fin fold line, which is the line separating the fin from the bottom end wall, the apex of the "V" being preferably situated in the vicinity of the center of the bottom end wall and pointing away from the sealing fin and toward the edge of the fully constructed container bottom.

Another preferred embodiment has two similar V-shaped creases which extend across the bottom end wall of the container. These creases remain unsealed. The bottom sealing fin, which is of uniform width as in conventional containers, is sealed straight across the bottom end wall adjacent to the center of the end wall. (As used in this specification and in the claims, the term "adjacent" is meant to denote a location at or in the vicinity of an indicated feature). The two V-shaped creases run beside the sealing fin, one on each side of the fin, the apex of each "V" being preferably situated in the vicinity of the center of the end wall and pointing away from the fin and toward the edge of the container bottom.

Still another embodiment of the invention has a single substantially V-shaped crease line which extends across the bottom end wall adjacent to the bottom sealing fin, the apex of the "V" being preferably situated in the vicinity of the center of the end wall and pointing away from the fin and toward the edge of the container bottom.

The blank of the invention from which the container of the invention is formed is scored with lines delineating three side wall portions, top and bottom end wall panels which will become part of the top and the bottom end walls of the container, respectively, sealing fin panels which run along at least some of the outer edges of the blank, and corner panels which will form dog ears during construction of the container. The blank also has a substantially V-shaped crease line which runs generally beside the bottom edge of the bottom end wall panel, the arms of the "V" extending generally toward the bottom edge of the blank and the apex of the "V" pointing generally toward the center of the bottom end wall panel.

In a first preferred embodiment of the blank of the invention, the above-described V-shaped crease line is the bottom sealing fin fold line, that is, the line connecting the bottom end wall panel with the bottom sealing fin panel and along which the bottom sealing fin panel is sealed and folded against the bottom end wall during construction of the container. As such, the crease line demarcates a roughly triangular bottom sealing fin which is wider at its midpoint than at its edges.

In a second preferred embodiment, an additional crease line which runs straight across the bottom edge of the bottom end panel serves as the bottom sealing fin fold line. The V-shaped crease line is situated immediately adjacent to this straight sealing fin fold line, the arms of the "V" preferably intersecting the fold line adjacent to the bottom corners of the bottom end wall panel. Both embodiments promote an inward bending of the container bottom that improves the flatness of the bottom and the stability of the container.

Alternatively, the bottom end wall panel of the blank of the invention can be viewed as including the bottom sealing fin panel. Viewed in this way, the bottom end wall panel has a generally pentagonal border portion including the sealing fin panel, adjacent to the bottom edge of the blank. In the first preferred embodiment, the border portion is identical to the bottom sealing fin panel while in the second preferred embodiment, the border portion includes the bottom sealing fin panel and a triangular area adjacent to the sealing fin panel, the apex pointing generally toward the center of the bottom end wall panel.

The blank of the invention as described above represents one half of the complete container. According to another preferred embodiment, the blank of the invention is joined along its upper edge to the upper edge of an identical blank, forming a double blank comprising two homologous, or mirror image, sections. A crease line can be provided between the two sections of the double blank. The double blank is folded along this transverse crease line, bringing the bottom edges of the two sections together. The side and bottom edges are sealed to form a flattened container. Alternatively, the homologous sections of the double blank can be joined along a side edge or along the bottom edge instead of at their top edges. (If the container is to be used for packaging a beverage, one blank of each double blank embodiment may have a hole or a thinned or weakened area on the top end wall panel for a straw. However, for simplicity, the two blanks that comprise a double blank will be referred to herein as identical or homologous without further reference to straw holes or other minor differences). According to an alternative embodiment of the invention, the blank of the invention can be overlaid face-to-face with an identical blank and sealed along two side edges and the bottom edge to form a flattened container which is then easily constructed into the finished container.

For convenience, the container of the invention has been described in terms of a blank of the invention from which the container is formed. The invention is not so limited. The invention also comprises a laminate web having a plurality of prescored regions. The web is cut such that each prescored region is transformed into a blank to be folded to form the container of the invention.

These and other features and advantages of the invention will be better understood from a consideration of the following detailed description of the preferred embodiments thereof, taken in conjunction with the accompanying figures, in which like reference characters refer to like elements.

BRIEF DESCRIPTION OF THE FIGURES

FIG. 4 is a view of the bottom end wall of the container according to a preferred embodiment of the invention.

FIG. 5 depicts the fully constructed bottom of the container in accordance with a preferred embodiment of the invention.

FIG. 9 is a view of the bottom end wall of the container according to a second preferred embodiment of the invention.

FIG. 10 depicts the fully constructed bottom of the container in accordance with a second preferred embodiment of the invention.

DETAILED DESCRIPTION OF THE PREFERRED EMBODIMENTS

Figure 1:
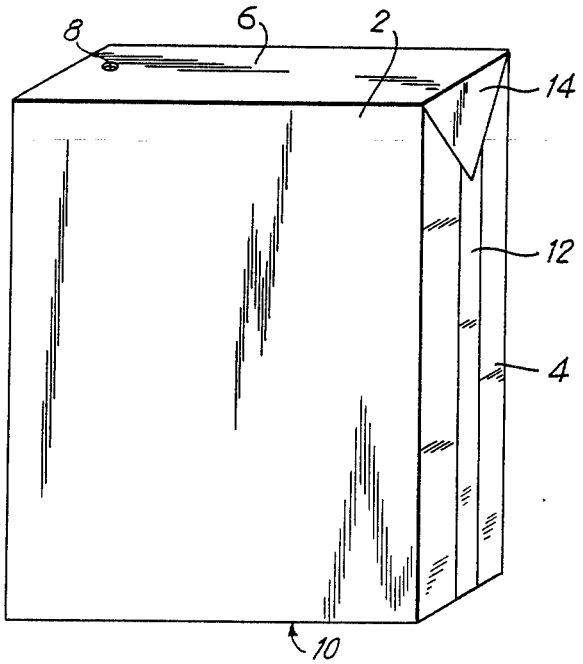
FIG. 1 is a perspective view of a container according to the invention.

FIG. 1 shows a brick-shaped container in accordance with the invention, comprising two large rectangular sidewalls 2 and two smaller rectangular sidewalls 4 (only one of each is in view), a top end wall 6 containing a strawhole 8, and a bottom end wall 10 (see FIG. 5). A sealing fin 12 runs along the center of side walls 4 and bottom end wall 10.

The container of the invention can be constructed from an unscored roll or sheet of semi-rigid, multi-layered material such as paperboard laminated with foil and polyolefin. The roll is fed into a conventional packaging system which scores the sheet so as to form a plurality of scored regions on the sheet, each region having the scoring pattern depicted in FIG. 2. Alternatively, each region may be scored with the scoring pattern shown in FIG. 7. The sheet is then folded and sealed by the system to form a closed tube. The tube is filled with a liquid or other substance, cross-sealed and cut into pouches which are then shaped into the container of the invention as shown in FIG. 1. Formation of the container into a parallelepiped entails the formation of dog ears 14, one at each corner of the container where the smaller rectangular side walls 4 meet top end wall 6 and bottom end wall 10. The bottom of the container is formed by folding the two bottom dog ears in against bottom end wall 10 (see FIGS. 5 and 10). Similarly, the container of the present invention may be constructed from a roll or sheet of semi-rigid material which is a laminate web having a plurality of prescored regions defined therein. Each region is prescored with the scoring pattern depicted in FIG. 2. Alternatively, each region may be prescored with the scoring pattern of FIG. 7. When fed into a conventional packaging system, the web is folded, sealed, cut and shaped to form the container of the invention as shown in FIG. 1.

Figure 2:
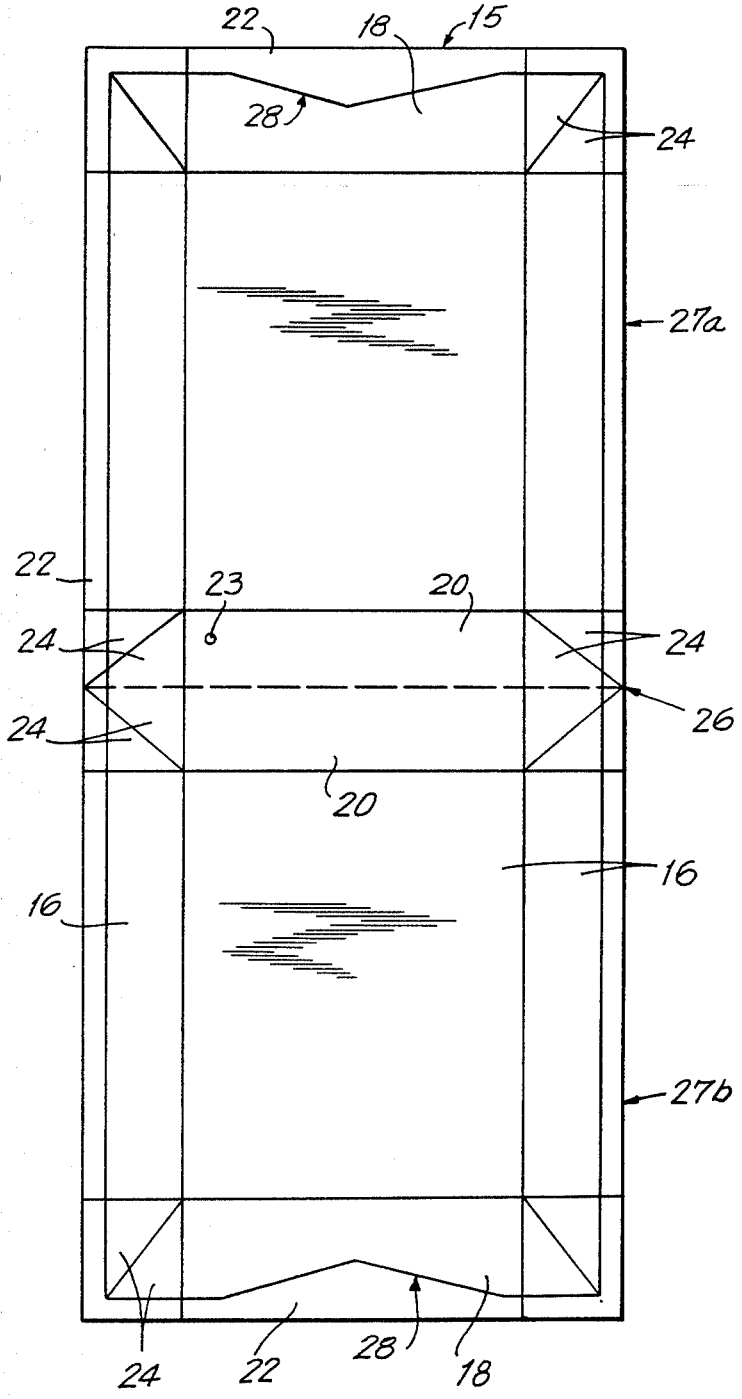
FIG. 2 is a planar view of a blank according to a preferred embodiment of the invention.

Alternatively, the container of the invention can be constructed from double blank 15 of FIG. 2. This blank is composed of paperboard or a similar semi-rigid material and is scored with a pattern of fold lines delineating side wall panels 16, bottom end wall panels 18, top end wall panels 20, sealing fin panels 22, and triangular areas 24 at each corner of the double blank and at the ends of the top end wall panels 20, which form dog ears during container construction. If the container is to be filled with a beverage, a round, thinned area of the container material intended to be punctured by the ultimate consumer as straw hole 23 is placed on one of the top end wall panels 20 of the double blank.

Double blank 15 is provided with a fold line 26 which extends transversely across the blank, bisecting the scored sheet into two homologous sections **27*a* and 27*b*, respectively. The blank is folded double along fold line 26 and is then sealed along sealing fin panels 22 (see FIG. 3) following procedures well known in the art. In the embodiment of FIG. 2, the V-shaped crease line 28 is actually the bottom sealing fin fold line 28, which separates bottom end wall panel 18 and the adjacent sealing fin panel 22. The arms of the "V" diverge generally toward the bottom edge of the blank, the apex of the "V" pointing generally toward the center of bottom end wall panel 18**.

Figure 3:
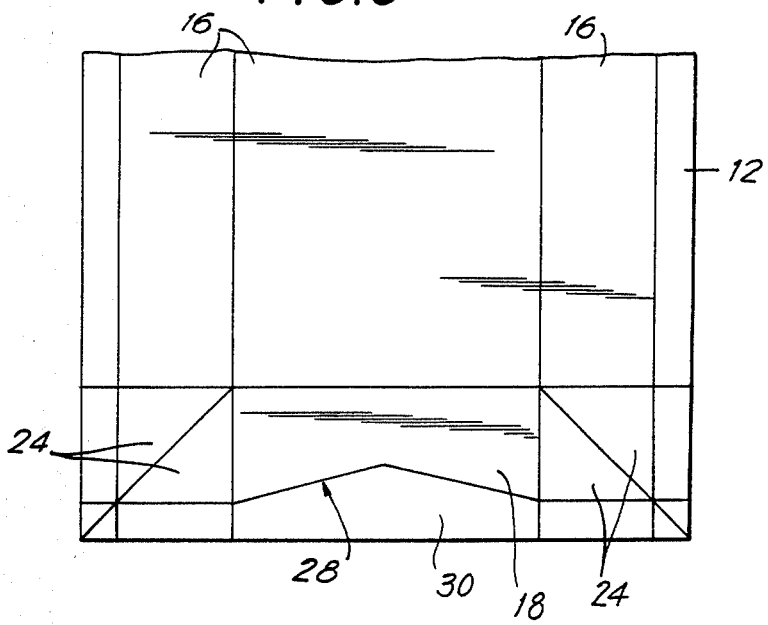
FIG. 3 represents a flattened container according to a preferred embodiment of the invention, made by folding and sealing the blank of FIG. 2.

FIG. 3 depicts the flattened container according to the invention which results when the blank of FIG. 2 is folded along middle fold line 26 and sealed along the two side edges and the bottom edge to form sealing fins. (Only one side of the flattened container is in view.) According to the embodiment of FIG. 3, sealing of the bottom edge of the container along sealing fin fold line 28 results in a roughly triangular bottom sealing fin 30, wider at its midpoint than at its ends, the apex of the fin pointing away from the bottom edge of the container. (Although only one side of the container is depicted, sealing fin fold line 28, along with the container is sealed, is provided on both sides of the flattened container.)

FIG. 4 shows the bottom end wall of the container of the invention according to the above-described preferred embodiment. Upon construction of the container, side wall panels 16 of blank 15 of FIG. 2 will become the rectangular side walls 2 and 4 of FIG. 1 (only two are in view) and the bottom end wall panels 18 of the blank 15 will become bottom end wall 10. Bottom dog ears 14 are formed from the triangular areas 24 at the corners of blank 51 of FIG. 2. These dog ears are triangular flaps located between bottom end wall 10 and the smaller rectangular side walls 4 of the container. In addition, sealing fins 32 run down the center of each smaller rectangular side wall 4 (only one such fin is in view). Bottom sealing fin 30 of FIG. 3 extends across the center of bottom end wall 10 and sealing fins 34 (which are extensions of the bottom sealing fin) run across the center of each dog ear 14 at either end of bottom end wall 10 as well. During formation of the container, sealing fins 30, 32 and 34 are folded against the walls of the container along which they run, resulting in flattened, sealed strips of double-thickness material running along the centers of those container walls.

In addition, FIG. 4 shows the V-shaped sealing fin fold line 28 of homologous blank section **27*a* of FIG. 2. The sealing fin fold line 28 of homologous blank section 27*b* cannot be seen on FIG. 4 because the sealing fin 30 has been folded over it. The container of the invention has been sealed along these two fold lines to form a roughly triangular bottom sealing fin 30**, as depicted by the triangular area in the figure.

Figure 6:
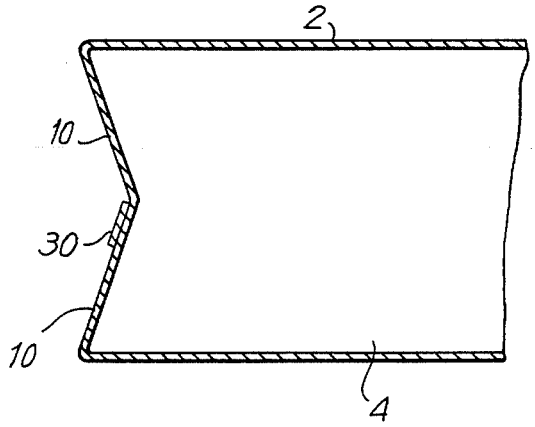
FIG. 6 is a cross-sectional view from section line 6—6 in FIG. 5 of the container bottom in accordance with the invention and shows the inward bending of the central portion of the bottom end wall.

FIG. 5 shows a view of the bottom of the container in accordance with the preferred embodiment of the invention. The container bottom is fully constructed, dog ears 14 having been folded over against bottom end wall 10. It is this folding against bottom end wall 10 of dog ears 14, which themselves contain folded over sealing fins 34, which in many conventional containers results in the problem of bulging at the bottom of the container. The sealing pattern of the container of the invention solves this problem of excess material at the container bottom by providing a mechanism for an inward bending of the central portion of bottom end wall 10 as depicted in the cross-sectional view of FIG. 6.

In the embodiment of FIGS. 2, 3, 4, and 5, the roughly triangular bottom sealing fin is narrow at its outer edges, but widens towards its midpoint, where it reaches its greatest breadth, at the apex of the sealed V-shaped crease line (see FIGS. 3 and 4). It is believed that, due to the width of the seal at the midpoint, the area of the bottom end wall is reduced, naturally creating an inward bending of the bottom end wall. Folding of the dog ears in against the wall exerts an additional pressure which promotes a further inward bending of the bottom end wall, and provides a space for the dog ears and their sealing fins to be tucked into. The result is a more stable, flatter container bottom. In this embodiment, the apex of the triangular sealed area should not be so high as to cause the bottom end wall to buckle.

Figure 7:
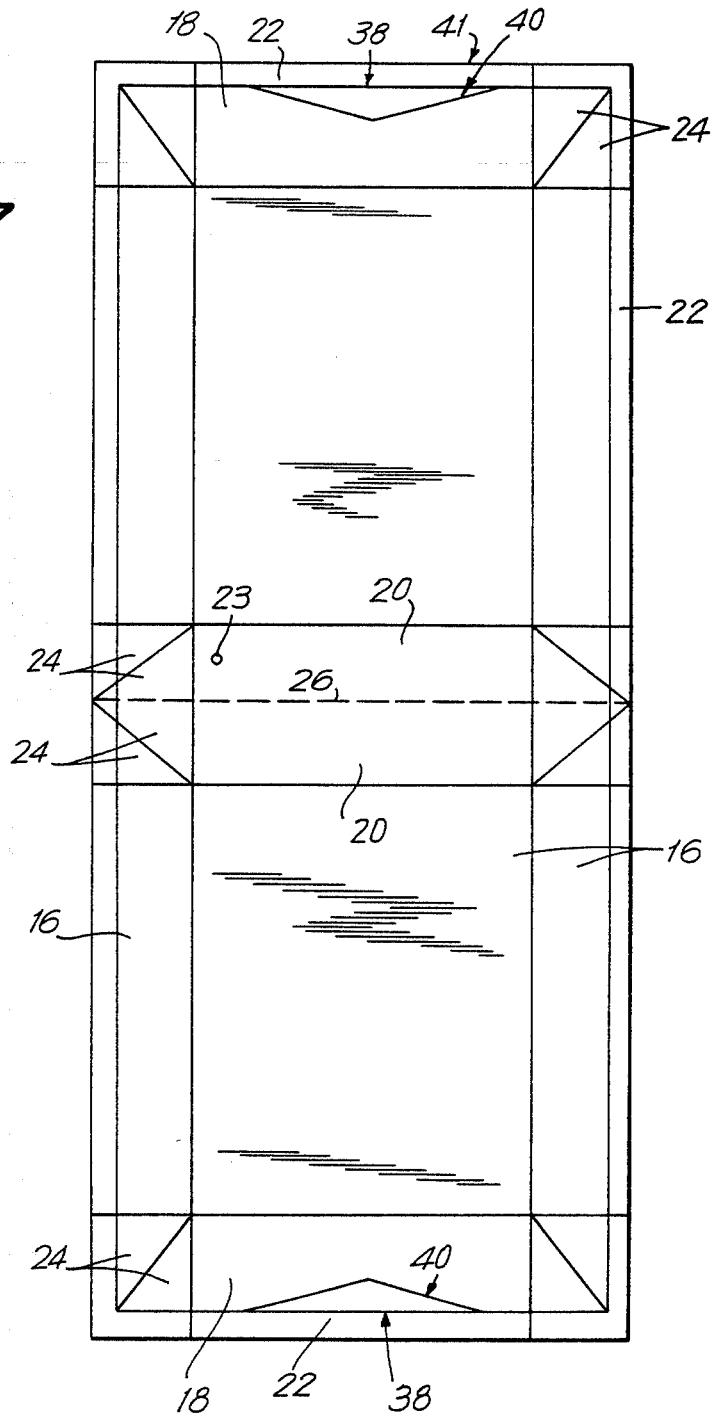
FIG. 7 is a planar view of a blank according to a second preferred embodiment of the invention.

A second preferred embodiment of the blank and container of the invention is depicted in FIGS. 7, 8, 9 and 10. Double blank 41 of this second embodiment, depicted in FIG. 7, is identical to that of the first embodiment described above as shown in FIG. 2 except that bottom sealing fin fold line 38 is a straight line. The V-shaped crease line 40 traverses each bottom end wall panel 18 of double blank 41, intersecting straight bottom sealing fin fold line 38 at either end of each bottom end wall panel 18 and extending diagonally upward toward the center of each end wall panel from both directions to form, in each panel 18, a triangle whose apex points away from the edge of the blank.

Figure 8:
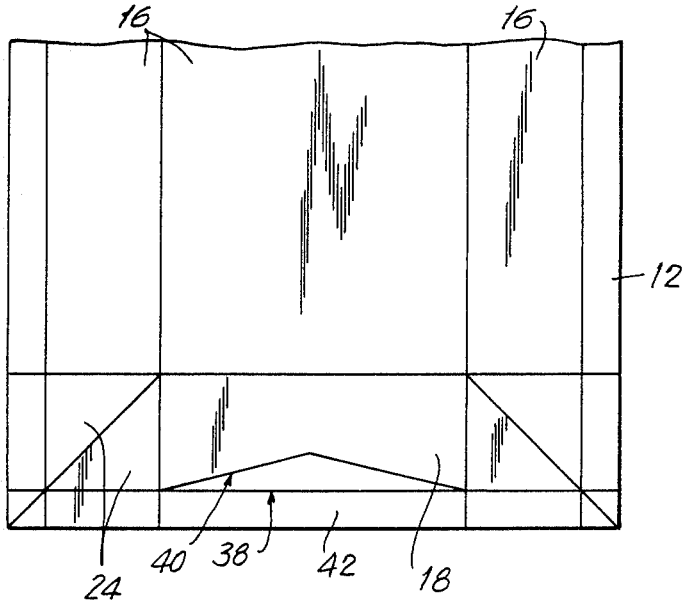
FIG. 8 represents a flattened container according to a second preferred embodiment of the invention, made by folding and sealing the blank of FIG. 7.

Folding of the blank of FIG. 7 along middle fold line 26 results in the flattened container of FIG. 8 wherein the bottom edge of the container is sealed along straight sealing fin fold line 38 to form a straight bottom sealing fin 42 of uniform width. Again, the V-shaped crease line 40 intersects straight sealing fin fold line 38 at each end of bottom end wall panel 18 extending diagonally upward toward the center of the end wall panel from both directions to form a triangle whose apex points away from the bottom edge of the flattened container. The triangular area bounded by crease line 40 which runs on either side of the container is left unsealed.

FIGS. 9 and 10 depict the bottom end wall of the second preferred embodiment before and after folding of the dog ears in against the end wall. The V-shaped crease lines 40 run beside straight bottom sealing fin 42 on each side of the fin, the apices pointing away from the fin. A diamond shaped area on bottom end wall 10 of the container bounded by the two crease lines 40 remains unsealed. (FIGS. 9 and 10 depict one of the V-shaped crease lines 40 and the apex of the other protruding from beneath sealing fin 42.)

In the embodiment of FIGS. 9 and 10, the area bounded by the two V-shaped crease lines running along the bottom sealing fin remains unsealed. Rather, these crease lines provide flexibility in the semi-rigid material of the container along the crease lines that results in an inward bending of the bottom end wall along the crease lines upon folding of the dog ears. The height of the V-shaped creases can be selected within a wide range depending upon the rigidity of the container material and upon the flexibility desired.

For convenience, the novel crease lines of the present invention have been described herein as "substantially V-shaped". It is to be understood that the crease lines may vary somewhat in shape from that of a "V". For example, the apex of the "V" may be somewhat rounded or the arms of the "V" may be somewhat arcuate.

Although the present invention has been described in detail with reference to several preferred embodiments, many variations and modifications of these will now be apparent to those skilled in the art. Accordingly, the scope of the invention is to be limited, not by the details of the illustrative embodiments described, but only by the terms of the appended claims.

I claim:

1. A laminate web of semi-rigid material, the web comprising a plurality of prescored regions, each of the prescored regions defining a blank for forming a container with a bottom of improved flatness and stability and comprising:

first, second and third adjacent side wall portions, the first side wall portion being joined to the second side wall portion along a crease line and the second side wall portion being joined to the third side wall portion along another crease line;

a bottom end wall panel joined to the second side wall portion along a third crease line; and first and second corner panels each joined by respective crease lines to the bottom end wall panel and to a respective one of the first and third side wall portions;

the bottom end wall panel having a substantially V-shaped crease line which extends from a first point, adjacent to the first corner panel, toward the second side wall portion to a second point and from the second point away from the second side wall portion to a third point adjacent to the second corner panel.

2. The web of claim 1, wherein, in each of the prescored regions, the V-shaped crease line is situated adjacent to the portion of the bottom end wall panel opposite the second side wall portion.

3. The web of claim 1, wherein, in each of the prescored regions, the bottom end wall panel has an additional straight crease line extending from the first point to the third point.

4. The web of claim 1, wherein each prescored region has an upper edge opposite the bottom end wall portion and is joined along the upper edge to an identical prescored region.

5. The web of claim 3, wherein each prescored region has an upper edge opposite the bottom end wall portion and is joined along the upper edge to an identical prescored region.

6. A sheet of a semi-rigid material for forming a container with a bottom of improved flatness and stability, the sheet of material comprising:

first, second, and third adjacent side wall portions, the first side wall portion being joined to the second side wall portion along a crease line and the second side wall portion being joined to the third side wall portion along another crease line;

a bottom end wall panel joined to the second side wall portion along a third crease line; and first and second corner panels each joined by respective crease lines to the bottom end wall panel and to a respective one of the first and third side wall portions;

the bottom end wall panel having a substantially V-shaped crease line which extends from a first point adjacent to the first corner panel toward the second side wall portion to a second point, and from the second point away from the second side wall portion to a third point adjacent to the second corner panel.

7. The sheet of material of claim 6, wherein the V-shaped crease line is situated adjacent to the portion of the bottom end wall panel opposite the second side wall portion.

8. The sheet of material of claim 6, wherein the bottom end wall panel has an additional straight crease line extending from the first point to the third point.

9. The sheet of material of claim 6, wherein the sheet has an upper edge opposite the bottom end wall portion and is joined along the upper edge to an identical sheet.

10. The sheet of material of claim 8, wherein the sheet has an upper edge opposite the bottom end wall portion and is joined along the upper edge to an identical sheet.

11. The sheet of material of claim 9, wherein the sheet is a blank for forming a container with a bottom of improved flatness and stability.

12. The sheet of material of claim 10, wherein the sheet is a blank for forming a container with a bottom of improved flatness and stability.

13. The sheet of material of claim 6, wherein the sheet is a web having a prescored region including the first, second, and third adjacent side wall portions, the bottom end wall panel having a substantially V-shaped crease line, and the first and second corner panels; the web also having at least one additional prescored region identical to the first prescored region.

14. A sheet of a semi-rigid material for forming a container with a bottom of improved flatness and stability, the sheet of material comprising:

first, second, and third adjacent side wall portions, the first side wall portion being joined to the second side wall portion along a first crease line and the second side wall portion being joined to the third side wall portion along a second crease line;

a top end wall panel having first, second, third, and fourth consecutive sides, the third side joined to the second side wall portion along a third crease line;

a bottom end wall panel having first, second, third, and fourth consecutive sides, the first side joined to the second side wall portion along a fourth crease line;

a first corner panel joined to the first side wall portion along a fifth crease line and joined to the fourth side of the top end wall panel along a sixth crease line, the first corner panel being bisected into two triangular areas by a seventh crease line extending from the intersection of the fifth and sixth crease lines to the opposite corner of the panel;

a second corner panel joined to the third side wall portion along an eighth crease line and joined to the second side of the top end wall panel along a ninth crease line, the second corner panel being bisected into two triangular areas by a tenth crease line extending from the intersection of the eighth and ninth crease lines to the opposite corner of the panel;

a third corner panel joined to the first side wall portion along an eleventh crease line and joined to the fourth side of the bottom end wall panel along a twelfth crease line, the third corner panel being bisected into two triangular areas by a thirteenth crease line extending from the intersection of the eleventh and twelfth crease lines to the opposite corner of the panel; and a fourth corner panel joined to the third side wall portion along a fourteenth crease line and joined to the second side of the bottom end wall panel along a fifteenth crease line, the fourth corner panel being bisected into two triangular areas by a sixteenth crease line extending from the intersection of the fourteenth and fifteenth crease lines to the opposite corner of the panel;

the bottom end wall panel having a seventeenth crease line defining substantially a "V" and extending from a first point adjacent to the twelfth crease line toward the first side of the bottom end wall panel to a second point between the second and fourth sides of the bottom end wall panel, and from the second point toward the third side of the bottom end wall panel to a third point adjacent to the fifteenth crease line.

15. The sheet of material of claim 14, wherein an additional crease line extends in a straight line from said first point to said third point.

16. A sheet of a semi-rigid material for forming a container with a bottom of improved flatness and stability, the sheet of material comprising:

first, second, and third adjacent side wall portions, the first side wall portion being joined to the second side wall portion along a crease line and the second side wall portion being joined to the third side wall portion along another crease line;

a bottom end wall panel joined to the second side wall portion along a third crease line; and first and second corner panels each joined by respective crease lines to the bottom end wall panel and to a respective one of the first and third side wall portions;

the bottom end wall panel having a generally pentagonal border portion opposite the second side wall portion, the border portion including a bottom sealing fin panel.

17. The sheet of material of claim 16, wherein the border portion is the bottom sealing fin panel.

18. The sheet of material of claim 16, wherein the border portion includes the bottom sealing fin panel and a triangular area adjacent to said panel and having an apex pointing generally toward the center of the bottom end wall panel and toward the second side wall portion.

19. A container made of a semi-rigid material and having a bottom of improved flatness and stability, the container comprising:

side wall portions, each of which is joined to two adjacent ones of the side wall portions;

a bottom end wall joined to the side wall portions; and a bottom sealing fin extending across the bottom end wall;

the bottom end wall having a substantially V-shaped crease line extending across the bottom end wall; and the bottom sealing fin being joined to the bottom end wall adjacent to the V-shaped crease line.

20. A container made of a semi-rigid material and having a bottom of improved flatness and stability, the container comprising:

side wall portions, each of which is joined to two adjacent ones of the side wall portions;

a bottom end wall having edges joined to respective ones of the side wall portions;

a bottom sealing fin extending across the bottom end wall; and dog ears at two opposite ones of the edges of the bottom end wall and folded in against the bottom end wall;

the bottom end wall having a substantially V-shaped crease line so located as to cause bending of the bottom end wall toward the container interior when the dog ears are folded in against the bottom end wall.

21. A container made of a semi-rigid material and having a bottom of improved flatness and stability, the container comprising:

side wall portions, each of which is joined to two adjacent ones of the side wall portions;

a bottom end wall having first, second, third and fourth consecutive edges, each edge being joined to a respective one of the side wall portions;

a bottom sealing fin extending across the bottom end wall from a region adjacent to the middle of the fourth edge of the bottom end wall to a second region adjacent to the middle of the second edge of the bottom end wall;

the bottom end wall having a first and a second substantially V-shaped crease line;

the first crease line extending from a first point, adjacent to the fourth edge, toward the first edge to a second point, and from the second point away from the first edge to a third point adjacent to the second edge;

the second crease line extending from a fourth point, adjacent to the fourth edge, toward the third edge to a fifth point, and from the fifth point away from the third edge to a sixth point adjacent to the second edge; and the bottom sealing fin being joined to the bottom end wall between the first and second crease lines.

22. A container according to claim 21, wherein the bottom end wall has a third and fourth crease line, each extending in a straight line, respectively, from the first point to the third point and from the fourth point to the sixth point; the third and fourth crease lines defining the junction of the bottom sealing fin and the bottom end wall.

23. A container according to claim 21, wherein the first and second substantially V-shaped crease lines define the junction of the bottom sealing fin and the bottom end wall, whereby the bottom sealing fin is roughly triangular.

24. A container made of a semi-rigid material and having a bottom of improved flatness and stability, the container comprising:

first, second, third and fourth consecutive side wall portions, each side wall portion being joined to two others of the side wall portions along a respective vertical edge;

a top end wall having first, second, third and fourth consecutive sides, the first side being joined to the third side wall portion along a first horizontal edge, and the third side being joined to the first side wall portion along a second horizontal edge;

a first top dog ear joined to both the fourth side wall portion and the fourth side of the top end wall along a third horizontal edge, and a second top dog ear joined to both the second side wall portion and the second side of the top end wall along a fourth horizontal edge, each of the top dog ears having first and second surfaces and having a sealing fin on each of those surfaces, and the top dog ears being folded over against the fourth and the second side wall portion, respectively;

a bottom end wall having first, second, third and fourth consecutive sides, the first side being joined to the first side wall portion along a fifth horizontal edge and the third side being joined to the third side wall portion along a sixth horizontal edge;

a first bottom dog ear joined to both the fourth side wall portion and the fourth side of the bottom end wall along a seventh horizontal edge, and a second bottom dog ear joined to both the second side wall portion and the second side of the bottom end wall along an eighth horizontal edge, each of the bottom dog ears having first and second surfaces and having a sealing fin on each of those surfaces, and the bottom dog ears being folded over against the bottom end wall;

a first side sealing fin extending along the center of the fourth side wall portion from the top end wall to the bottom end wall;

a second side sealing fin extending along the center of the second side wall portion from the top end wall to the bottom end wall; and a bottom sealing fin extending across the center of the bottom end wall from the first bottom dog ear to the second bottom dog ear;

the bottom end wall having a first and a second substantially V-shaped crease line, each of the crease lines running across the bottom end wall adjacent to the bottom sealing fin;

the first crease line extending from a first point, adjacent to the fourth side of the bottom end wall, toward the first side to a second point, and from the second point away from the first side of the bottom end wall to a third point adjacent to the second side; and the second crease line extending from a fourth point, adjacent to the fourth side of the end wall toward the third side to a fifth point, and from the fifth point away from the third side of the end wall to a sixth point adjacent to the second side;

the V-shaped crease lines causing an inward bending of the bottom end wall at locations to accommodate at least a portion of the volume of the dog ears for improving the stability of the container bottom.

* * * * *